United States Patent [19]

Peterson

[11] Patent Number: 4,591,462

[45] Date of Patent: May 27, 1986

[54] FIRE CONTROL SYSTEM FOR A GAS AND LIQUID CONTACT APPARATUS

[75] Inventor: Charles A. Peterson, Bridgewater, N.J.

[73] Assignee: Hamon-Sobelco, Brussels, Belgium

[21] Appl. No.: 751,723

[22] Filed: Jul. 3, 1985

[51] Int. Cl.[4] ..... B01F 3/04; A62C 37/30

[52] U.S. Cl. ..... 261/108; 169/42; 169/59; 261/DIG. 11

[58] Field of Search ..... 261/108; 169/42, 57, 169/59

[56] References Cited

U.S. PATENT DOCUMENTS

| | | | |
|---|---|---|---|
| 1,080,228 | 12/1913 | Marshall . | |
| 1,120,817 | 12/1914 | Iman . | |
| 1,174,353 | 3/1916 | Rowley . | |
| 1,183,342 | 5/1916 | Carlson | 169/42 |
| 1,283,124 | 10/1918 | Evans . | |
| 1,479,999 | 1/1924 | McDonald | 169/42 |
| 1,508,376 | 9/1924 | Adams, Jr. . | |
| 2,226,744 | 12/1940 | Roessner | 169/42 |
| 2,730,900 | 1/1956 | Rowley . | |
| 3,463,236 | 8/1969 | Flajole et al. | 169/59 |
| 4,055,829 | 10/1977 | Ruegsegger | 169/42 |
| 4,269,794 | 5/1981 | Bosne et al. . | |

*Primary Examiner*—Tim Miles

*Attorney, Agent, or Firm*—Kerkam, Stowell, Kondracki & Clarke

[57] ABSTRACT

An installation for contacting a fluid with a gas is disclosed and comprises an enclosure provided in the lower part of its periphery with at least one gas inlet opening and in its upper part with at least one gas discharge opening. The contact unit is composed of a combustible material, and the unit is disposed in the enclosure above the gas inlet opening and is suspended from a framework by cables and the cables are connected by temperature responsive means adapted to cause release of the cables in response to the detection of a predetermined temperature at the most equal to the flame temperature of the contact unit.

6 Claims, 10 Drawing Figures

FIRE CONTROL SYSTEM FOR A GAS AND LIQUID CONTACT APPARATUS

BACKGROUND OF PRIOR ART

The present invention relates to gas and liquid contact installations.

Gas and liquid contact installations are employed for the cooling of a fluid, for example water, by means of atmospheric air. Generally, such installations comprise a heat exchange unit which is placed in an enclosure provided with an air inlet opening and an air outlet opening, and in which the water to be cooled is placed directly or indirectly in contact with the air between the air inlet and the air outlet from the enclosure. In the case of a direct contact heat exchange, the water is brought to the unit by a distribution system and is then sprayed or otherwise distributed on the heat exchange unit about which the air is passed. The latter may be constructed either in the form of an assembly of plates along which the water trickles in the form of thin films, or in the form of an assembly of surfaces which ensure the dispersion of the water in very fine droplets so as to form a mist which passes through the counter-current stream of air.

The heat exchange units are generally constructed from plastic materials, such as polystyrene, ABS, polyethylene, polypropylene or polyvinyl chloride These plastic materials are based on carbon and hydrogen and burn more or less easily. In the case of atmospheric coolers, fire dangers are insignificant when the cooler is in operation and supplied with water; this is not so when the exchanger is shut down and drained. Further, in the case of atmospheric coolers, or more generally gas and liquid contact installation in which the fluid to be cooled or placed in contact with the gas is not water, possibilities of fire may exist even when the installation is operating. It is consequently essential to provide means to prevent the spread of fire in such heat exchange units, which could result in unrepairable damage to the entire installation, and, also in the case where the exchange unit plates are formed of polyvinyl chloride, the emanation of highly toxic chlorinated compounds result from fires.

BRIEF SUMMARY OF INVENTION

An object of the invention is to provide a gas and liquid contact installation in which the contact unit is suspended from a framework inside the enclosure, as disclosed, for example, in U.S. Pat. No. 4,269,794 Bosne et al having means for preventing extensive fire damage to the contact units.

The present invention comprises an improvement over the structures of Bosne et al by simplifying the cable system and providing heat sensitive release means which are positively connected to certain of the cables thereby preventing accidental release of the contact apparatus and positive release of the contact apparatus when the heat sensitive means are subjected to a predetermined temperature.

According to the invention, there is provided a gas and liquid contact installation comprising an enclosure provided in the lower part of its periphery with at least one gas inlet opening and in its upper end with at least one gas discharge opening, and a gas and liquid contact unit composed of a combustible material. The contact unit is disposed in the enclosure above the gas inlet opening from a framework by cables.

The cables are connected to the gas and liquid contact by plastic links which separate at temperatures not greater than the flame temperature of the gas and liquid contact means. Upon separation the gas and liquid contact apparatus drops to the floor of the cooler, either into the water basin thereof or at a distance from the other contact units greater than reach of flames.

In the case where the contact unit is formed by a series of sub-assemblies individually suspended from the framework, each sub-assembly includes the temperature responsive means of the invention. This embodiment enables the sub-assemblies to become individually unhooked when they are enflamed and therefore tends to avoid further spreading of the fire to other contact units.

BRIEF DESCRIPTION OF THE DRAWINGS

Further characteristics and advantages of the invention will be apparent from the ensuing description of different embodiments illustrated by the accompanying drawings wherein.

DETAILED DESCRIPTION OF INVENTION

Figure 1:
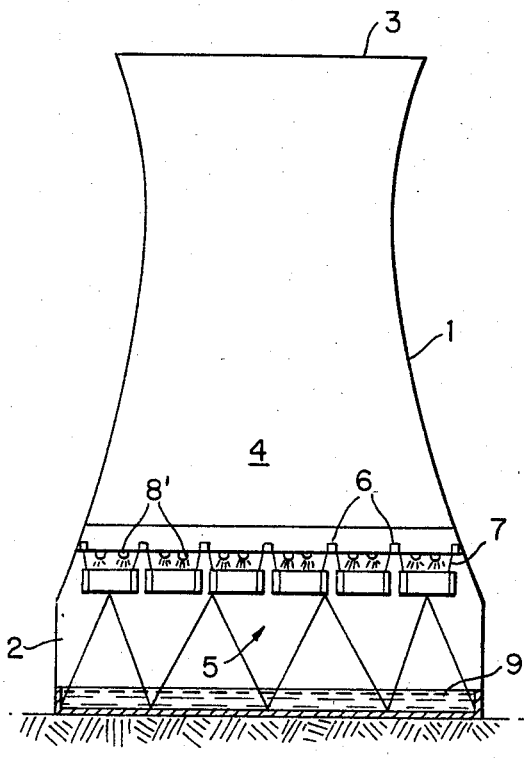
FIG. 1 is a diagrammatic longitudinal sectional view of an atmospheric cooler of the natural draught type.
Figure 2:
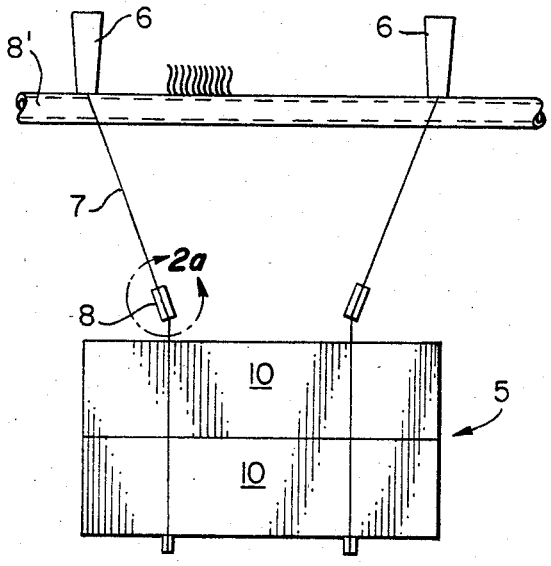
FIG. 2 is a perspective view of a heat exchange unit suspended from framework by cables and links according to a preferred embodiment of the invention.
Figure 2A:
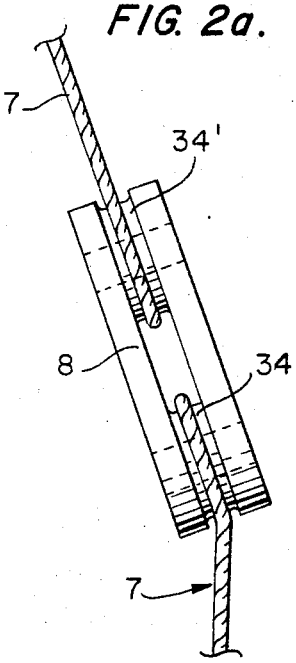
FIG. 2*a* is an enlargement of the zone indicated 2*a* in FIG. 2 illustrating a fusable link connected to a pair of cables.
Figure 8:
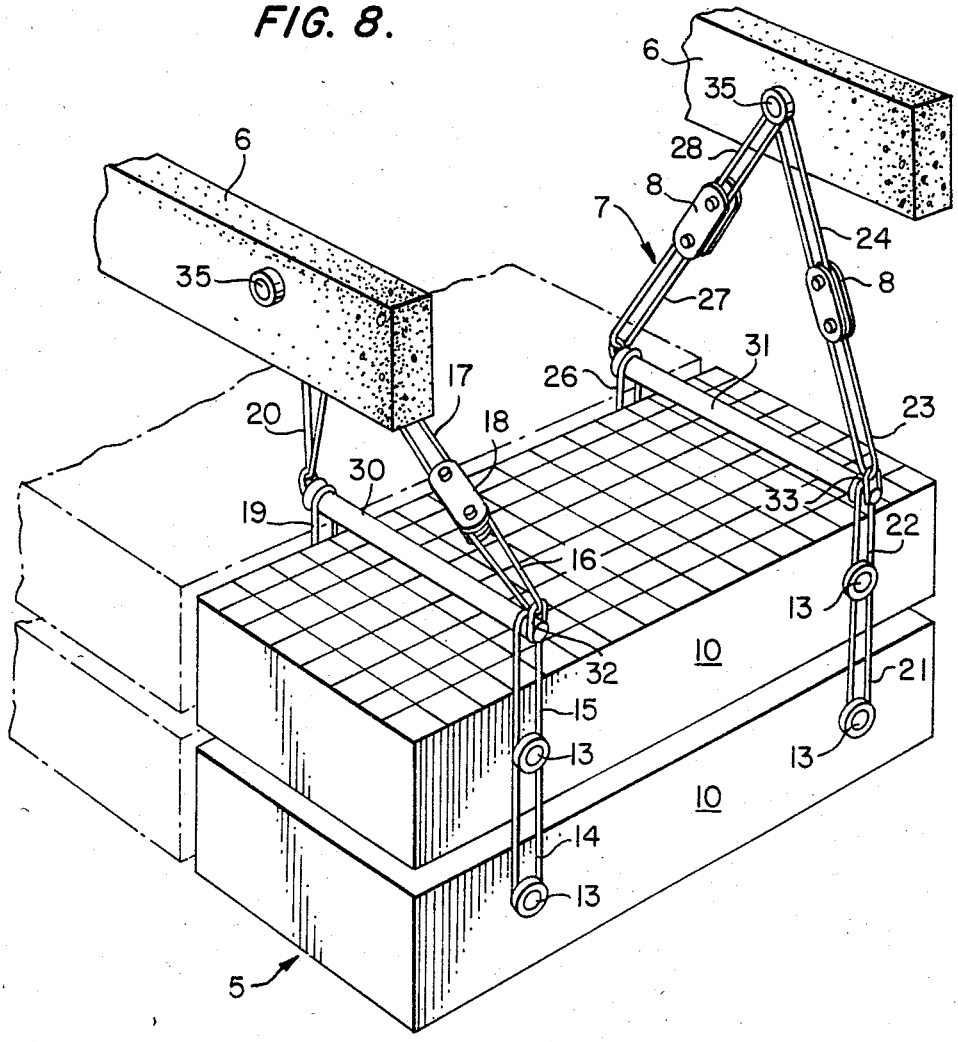
FIG. 8 is a perspective view of a contact unit mounted from beams employing the fusable link of the invention.

With reference first to FIGS. 1, 2 and 8 the illustrated atmospheric cooler comprises a hollow concrete chimney 1 provided at its base with peripheral air inlet openings 2 and in its upper part with an air discharge opening 3. Placed inside the enclosure 4 defined by the concrete walls of the chimney 1 is a heat exchange unit 5 suspended from a framework 6 by cables 7 and release members generally designated 8. In the illustrated embodiment, the heat exchange unit 5 is of the type in which water is cooled by direct contact with the air of the atmosphere. The water is distributed in the upper part of the unit 5 by a system of tubes 8' having the usual spray heads or the like. The cooled water which falls freely from the lower part of the contact unit 5 is received in a basin 9 which extends across the entire base of the enclosure or chimney 1. In FIG. 1 an atmospheric cooler which operates by a direct contact of the water with the air of the atmosphere is illustrated it is to be understood that the ensuing description is not limited to this type of cooler as the invention is also applicable to coolers in which the fluid to be cooled is in indirect contact with the air of the atmosphere, and to coolers of the "compound" type comprising both indirect contact exchange units and direct contact exchange units. The invention is also applicable to induced draught coolers employing suction or blower fans.

Referring to FIGS. 2 and 8 which show an exchange unit 5 comprising a number of sub-assemblies 10. Each sub-assembly 10 comprises a group of parallel-sided elements which are superimposed and vertically spaced apart from each other. These units are shown diagrammatically and may have any suitable shape whereby it is possible to direct a spray of liquid against their upper ends to place the liquid in direct contact with a gas which enters them by way of their lower open ends.

The units 10 are held in suspension by means of suspension members or cables 7 etc. consisting of cables or draft members which pass around the end of pins 13 fixed horizontally in the elements 10. In the illustrated embodiment, the elements 10 are hooked to each other at four points which are deposed symmetrically on the two opposed longer sides of the elements.

Referring specifically to FIG. 8 the cables 7 are illustrated as 16 in number for each of the units of contact apparatus. Each of the 16 cables is in the form of a loop and are designated 14 through 20 for one end of the units and 21–28 at the other end. In FIG. 8 cables 18 and 25 which connect two units 10 one to the other on the far side of the units illustrated are not shown. Cables 14 and 21 on the near side are slipped about pins 13; cables 15 and 22 are slipped about the upper pins 13 and around spacer bars 30 and 31. Cables 16 and 23 are looped about rings 32 and 33 carried at one end of each of the spacer bars 30 and 32 thence about the lower spool portion of one of the fusable links 8. Cables 17 and 24 are looped about the other spool portion 34' of the pair of links 8 while the other ends of cable 17 and 24 are looped about pins 35 horizontally carried by the network of support beams 6. The opposite side cables are similarly connected to the contact apparatus 10, spacer bars 30 and 31 and beam carried pins 35.

Figure 3:
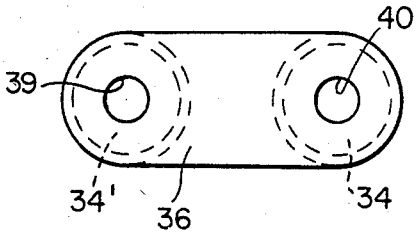
FIG. 3 is a planned view of one of the fusable links.
Figure 4:
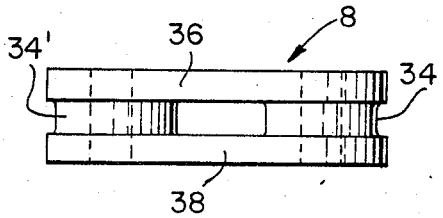
FIG. 4 is a side elevational view of the link illustrated in FIG. 3.

Referring now more specifically to FIGS. 3 and 4 heat sensitive the units or links 8 are cast or molded in two parts from for example polypropylene and cemented together. When molded the two sections 36 and 38 have bridge portions 41 which connect the pair of spool portions 34 and 34'. The units are molded with bores 39 and 40 through the spool portions 34 and 34'. These bores reduce the mass of polypropylene at the spool portions and help to ensure that link failure occurs at the spool portions.

The isotactic form of polypropylene is particularly well suited for the fusable links as the solid material softens at about 155° C. and has a melting point at about 165° C. Further, polypropylene is practically insoluble in cold organic solvents and is resistant to acids, alkalies, and has a good resistance to abrasion.

Where a lower melting point plastic is desired polyethylene may be used having a heat distortion temperature in the range of 115° to 122° C. Whereas nylon has a heat distortion temperature in the range of 165° to 170° C.

Figure 5:
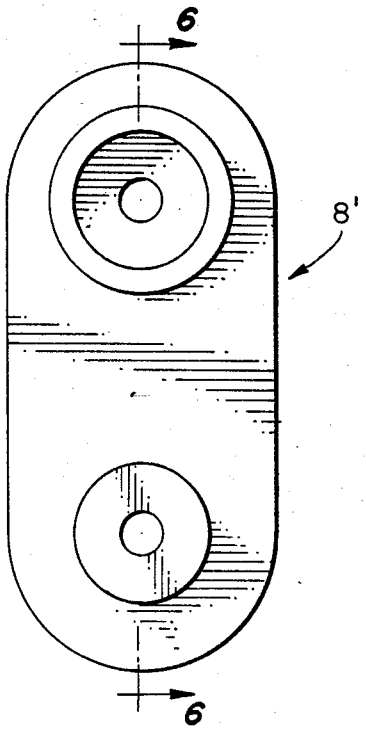
FIG. 5 is a view of one side of a preferred form of the fusable link.
Figure 6:
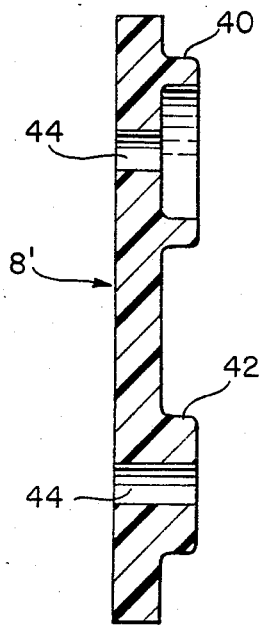
FIG. 6 is a section on line 6—6 of FIG. 5.
Figure 7:
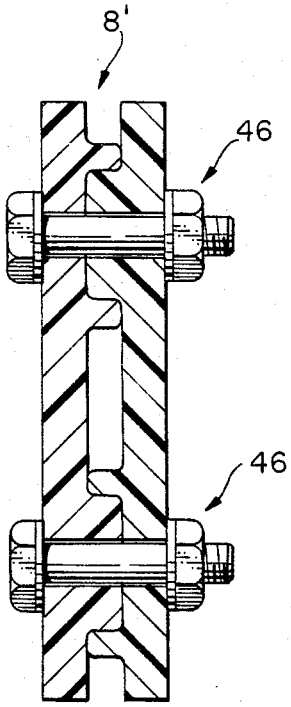
FIG. 7 illustrates a pair of units illustrated in FIG. 5 connected together by bolts.

Referring now to FIGS. 5, 6 and 7 a modified form of link designated 8' is illustrated. The link 8' is molded in two sections and has a pair of spool portions 40 and 42. Spool portion 42 is a male counterpart of female spool portion 40 thus when a pair of elements 8' are placed together the male spool portion fits internally in the female spool portion 40. Like the other form of the invention each of the spool portions is provided with a through opening 44. The through openings 44 are adapted to receive a nut and bolt assembly generally designated 46 which assists in maintaining the two elements together until a clear fusion temperature is reached. Further the nut and bolt assemblies 46 prevent distortion of the fusable links 8 caused by heat below the melting temperature and the weight of the contact units suspended therefrom. In addition to maintaining the pair of units together with nut and bolt assemblies cement or glue is generally applied to the male and female spools.

Figure 9:
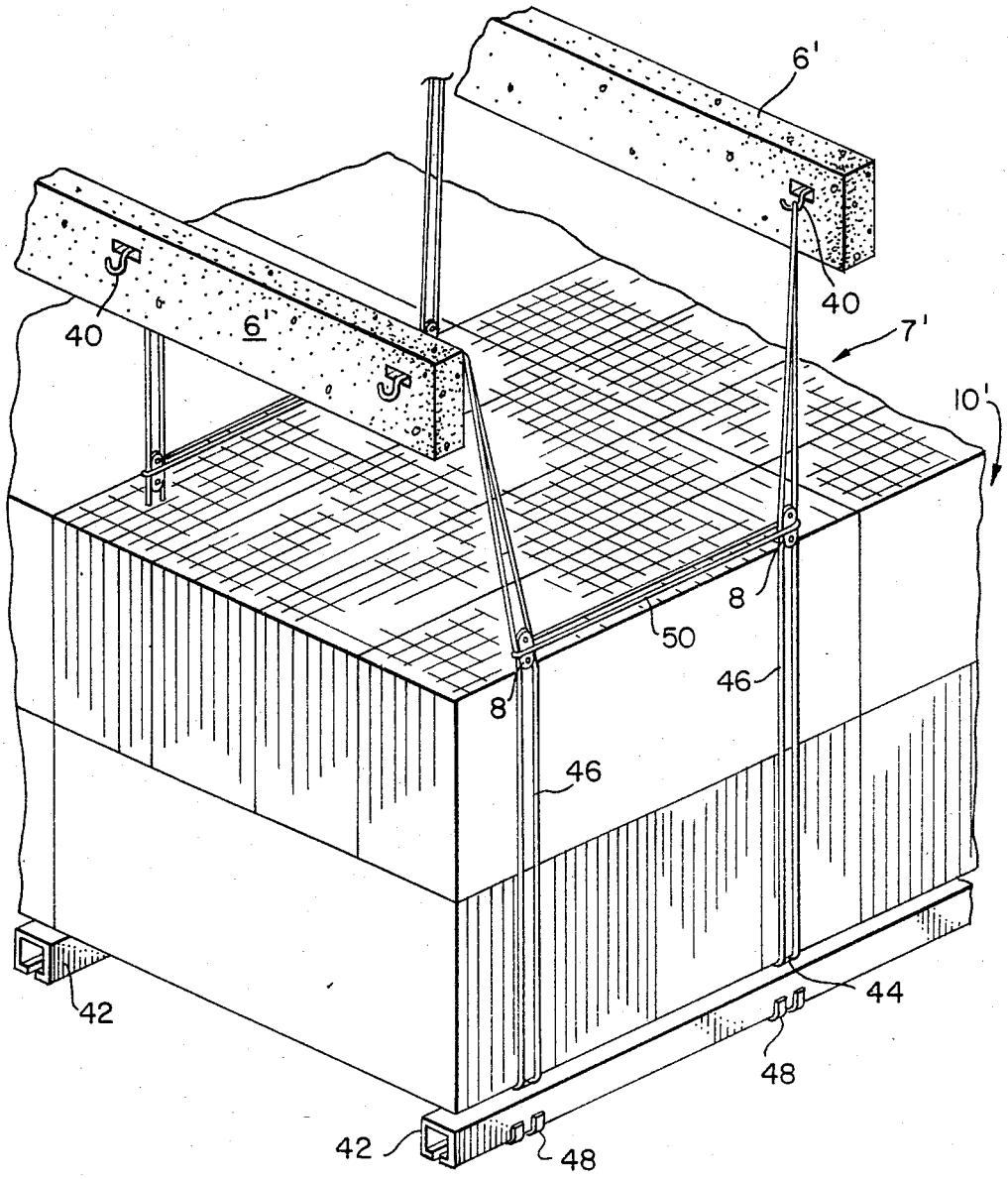
FIG. 9 is a perspective view like FIG. 8 of a modified mounting means for contact units.

Referring now to FIG. 9 a modified suspension means employing the fusible links 8 is illustrated. In FIG. 9 above the sub-assemblies 10' is a network of beams 6' provided with hooking means 40 which receives upper loops of the suspension members or cables 7'. Below the sub-units 10' are hollow beams 42 made, for example, of PVC plastic. The beams are provided with slot-like openings 44 which receive the lower ends of suspension wires 46 and are secured to the hollow beams 42 by clamps or clips 48. Suspension cables 7' are joined to suspension cables 46 by the fusible links 8. Where needed wires 50 connect a side-by-side pair of suspension members as illustrated at 50. With this form of suspension a number of sub-assemblies 10' are releasably suspended by four fusible links 8. The simplicity of the suspension system shown in FIG. 9 makes for easier and less expensive but eqaully as effective assembly as the suspension means illustrated in FIG. 8.

I claim:

1. An installation for contacting a liquid with a gas comprising an enclosure, a gas inlet at the lower end of the enclosure and an upper gas outlet from the enclosure, a plurality of gas and liquid contact units composed of combustible material disposed in the enclosure above the gas inlet opening, horizontal frame means in the enclosure, cables suspending the gas and liquid contact units from said frame means and fusable links in said suspending cables, said fusable links comprising a pair of plastic hubs connected by a pair of spaced plastic bridge elements.

2. The installation as defined in claim 1 wherein the fusable links are formed as a pair of elements and cemented together.

3. The installation as defined in claim 2 wherein the plastic hubs have openings there through.

4. The installation as defined in claim 3 including bolt and nut assemblies through the openings in each hub.

5. The installation as defined in claim 3 wherein the links comprise polypropylene.

6. The installation defined in claim 4 wherein the links comprise polypropylene.

* * * * *